US006058609A

United States Patent [19]

Yen et al.

[11] Patent Number: 6,058,609

[45] Date of Patent: May 9, 2000

[54] KNIFE HOLDER

[76] Inventors: Jung-Chieh Yen; Wen-Chi Chen, both of P.O. Box 82-144, Taipei, Taiwan

[21] Appl. No.: 09/305,651

[22] Filed: May 5, 1999

[51] Int. Cl.[7] ..... B26B 27/00

[52] U.S. Cl. ..... 30/298.4; 206/553; 211/70.7; 248/37.3; 248/37.6; D7/637

[58] Field of Search ..... 30/298.4; 206/553; 211/70.7; 248/37.6, 37.3; D7/637

[56] References Cited

U.S. PATENT DOCUMENTS

| | | | |
|---|---|---|---|
| 2,357,646 | 9/1944 | Gilbert | 30/298.4 |
| 4,511,040 | 4/1985 | Tolentino | 206/553 |
| 4,561,548 | 12/1985 | Call | 211/70.7 |
| 4,575,939 | 3/1986 | Buchtel | 30/298.4 |
| 4,866,845 | 9/1989 | McEvily | 30/298.4 |
| 5,050,749 | 9/1991 | Scaglione | 211/70.7 |
| 5,245,756 | 9/1993 | Howell et al. | 30/298.4 |

*Primary Examiner*—Kenneth E. Peterson
*Assistant Examiner*—Sean Pryor
*Attorney, Agent, or Firm*—A & J

[57] ABSTRACT

A knife holder includes two transparent plates, a plurality of partitioning blocks, a plurality of securing blocks, and a plurality of larger securing blocks. The partitioning blocks are spaced equi-distantly apart between the plates such that the plates define a receiving space. Upper ends of the plates are provided with a plurality of pairs of opposite indentations. The receiving space and the indentations are sized to receive knives. The knives are divided by the partitioning blocks so that they do not overlap. The partitioning blocks have front and rear ends forming bolt portions that pass through corresponding through holes in the plates for screwable engagement with the securing blocks so that the plates can be screwably secured on the partitioning blocks. The larger securing blocks are secured at two lower corners of each plate so that the knife holder can stand on a planar surface. The knife holder not only permits partitioning of knives but also allows the user to see through the plates to identify correctly and quickly the knives needed, as well as prevents breeding of bacteria and mold.

1 Claim, 3 Drawing Sheets

KNIFE HOLDER

BACKGROUND OF THE INVENTION (a) Field of the Invention

The present invention relates to a knife holder, more particularly a knife holder that not only allows partitioning of knives but also allows the user to see therethrough to quickly and correctly identify the knives needed, as well as prevents breeding of bacteria and mold.

(b) Description of the Prior Art

Every home generally has more than one knife for use in food preparation. How to keep the knives safely from the reach of children is very important. A conventional knife holder is shown in FIG. 1. As the conventional knife holder is usually made of wood and includes virtually enclosed compartments for keeping knives, after a washed knife is inserted into the compartment, bacteria and mold will breed inside due to dampness. Furthermore, as the wooden knife holder does not allow the user to see through the compartments, the user may not quickly and correctly identify the knife he/she needs, which is inconvenient.

SUMMARY OF THE INVENTION

A primary object of the present invention is to provide a knife holder that not only allows partitioning of knives but also allows the user to see therethrough to quickly and correctly identify the knives needed, as well as prevents breeding of bacteria and mold.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
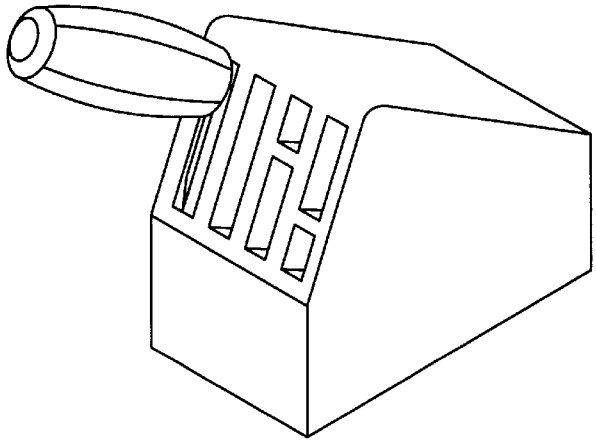
PRIOR ART FIG. 1
FIG. 1 is a perspective view of the prior art.
Figure 2:
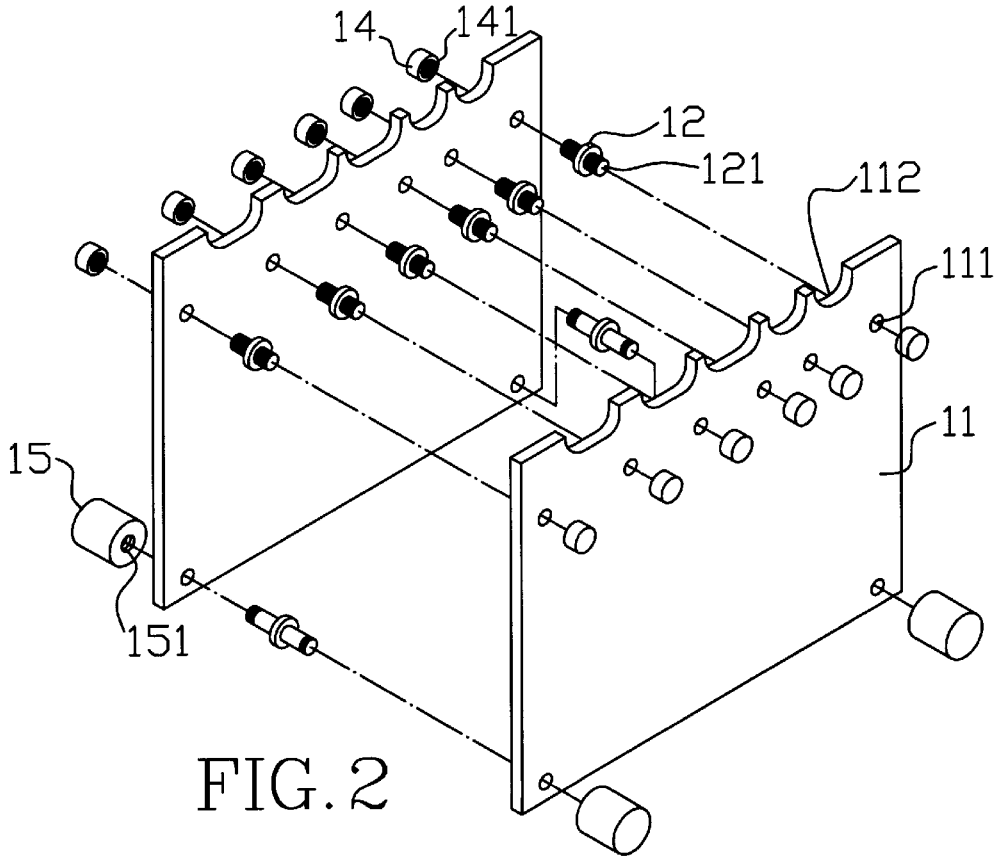
FIG. 2 is an exploded perspective view of the present invention.
Figure 3:
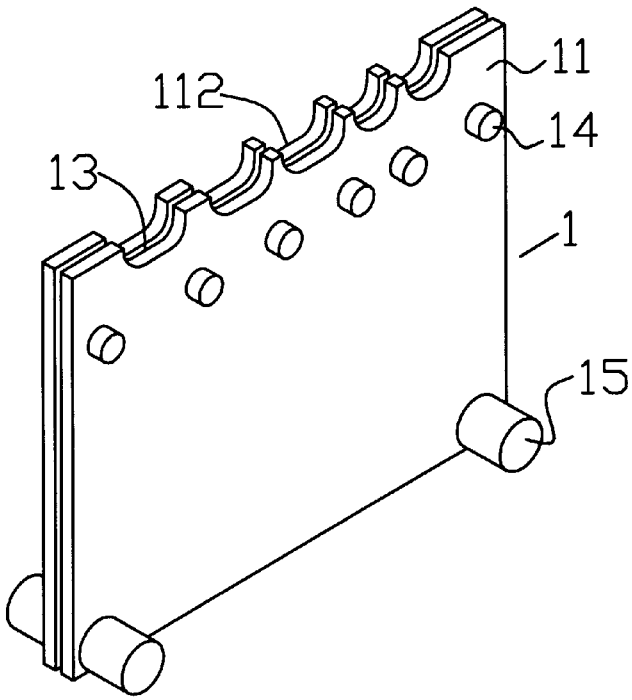
FIG. 3 is an assembled perspective view of the present invention.
Figure 4:
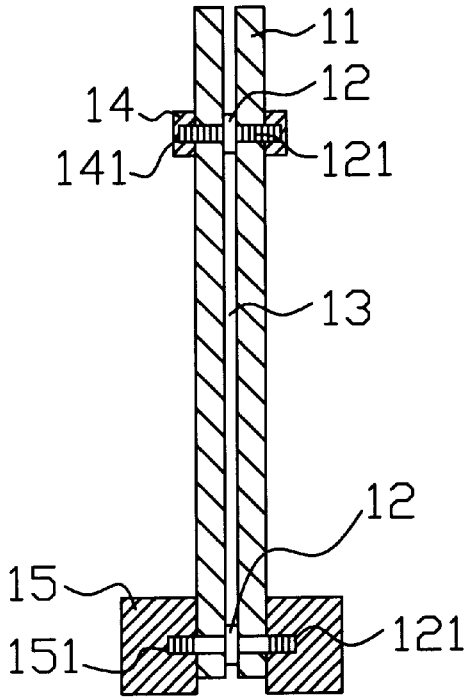
FIG. 4 is an assembled sectional side view of the present invention.

With reference to FIGS. 2, 3 and 4, a preferred embodiment of a knife holder according to the present invention is shown to comprise a holder body 1 that includes two plates 11, a plurality of partitioning blocks 12, securing blocks 14, and a plurality of larger securing blocks 15.

The plates 11 are identical in size and formed of a transparent material. The plates 11 have upper ends formed with a plurality of indentations 112 for insertion of knives 2. The number of the indentations 112 may vary depending on the desired number of knives to be kept. Opposite inner sides of the plates 11 are provided with a plurality of corresponding through holes 111 that are spaced equi-distantly apart. Each through hole 111 is substantially located between two adjacent through holes at a suitable position. The plates 11 are erected opposite to each other in a spaced-apart relationship with the partitioning blocks 12 disposed therebetween. The partitioning blocks 12 can pass through the through holes 111 on both sides thereof, and the securing blocks 14 are used to screwably secure the partitioning blocks 12 between the plates 11, such that a receiving space 13 is defined between the plates to receive knives 2. The receiving space 13 is divided by the partition blocks 12 into a plurality of compartments for receiving the knives 2. Each plate 11 is further provided with two lower corner through holes 11. Two partitioning blocks 12 are disposed between the lower corner through holes 111 of the plates 11, and the larger securing blocks 15 are used to screwably secure the two partitioning blocks 12 between the plates 11. By means of the larger securing blocks 15, a holder body 1 of the present invention can be erected on a planar surface.

The partitioning blocks 12 are generally cylindrical in shape and include two opposite ends each forming a bolt portion 121 that is configured to be able to pass through the corresponding through hole 111 in the plates 11 and project a certain distance from outer sides of the plates 11 for screwable engagement with the securing blocks 14 or the larger securing blocks 15.

The securing blocks 14 are generally cylindrical and provided with a central screw hole 141 at one end such that the screw hole 141 can screwably engage one of the bolt portions 121 of a respective one of the partitioning blocks 12 to allow assembly of the plates 11 and the partitioning blocks 12.

The larger securing blocks 15 are generally cylindrical and are larger than the securing blocks 14 in size. Each larger securing block 15 is provided with a central screw hole 151 at one end for screwable engagement with one of the bolt portions 121 of a respective one of the partitioning blocks 1 disposed between corner through holes of the plates 11.

Figure 5:
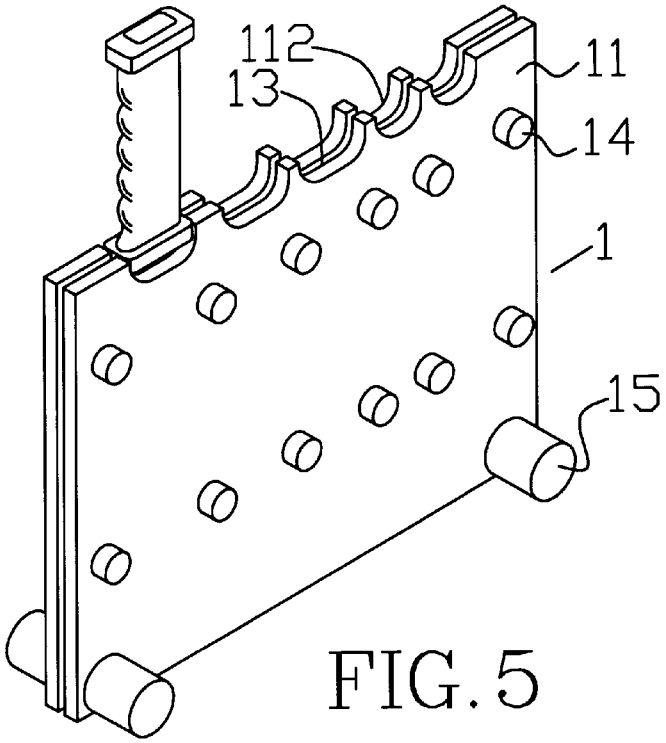
FIG. 5 shows a modified embodiment of the present invention.
Figure 6:
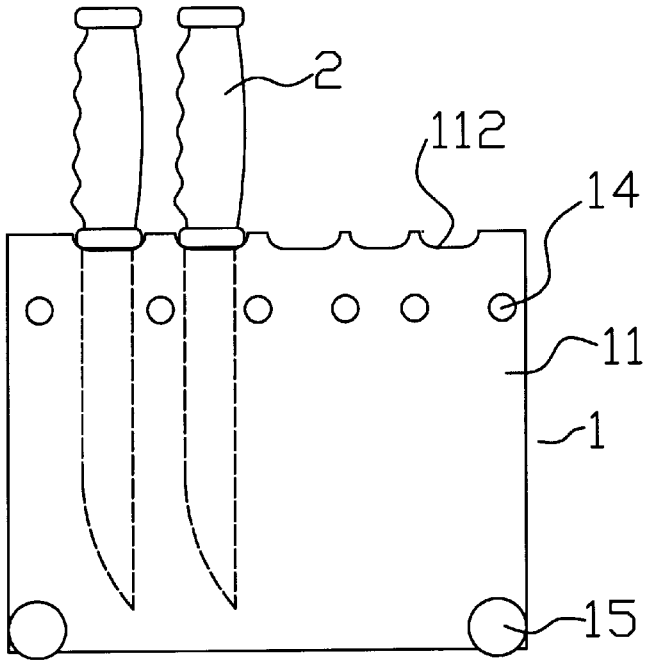
FIG. 6 is a schematic view of the present invention in use.

In assembly, referring further to FIGS. 2, 3 and 4, the partitioning blocks 12 are mounted between the plates 11 such that the bolt portions 121 thereof pass through and partly project from the corresponding through holes 111 in the plates 11 for screwable engagement with the securing blocks 14 and the larger securing blocks 15. The securing blocks 14 correspond to the partitioning blocks 12 and are spaced equi-distantly apart to partition the knives 2. The partitioning blocks 12 and the securing blocks 14 may be configured to run in one or two rows, as shown in FIG. 5. The larger securing blocks 15 project from the plates 11, whereby the holder body 1 can stand on the planar surface.

In view of the aforesaid, the knife holder of the present invention not only provides partitioning of knives, as the plates 11 are made of a transparent material, the shapes of the knives can also be readily seen so that the user can quickly take out the knife he/she needs. Besides, breeding of bacteria and mold can be avoided.

Although the present invention has been illustrated and described with reference to the preferred embodiment thereof, it should be understood that it is in no way limited to the details of such embodiment but is capable of numerous modifications within the scope of the appended claims.

What is claimed is:

1. A knife holder comprising two plates, a plurality of partitioning blocks, a plurality of securing blocks, and a plurality of larger securing blocks, wherein said plates are made of a transparent material, said partitioning blocks being disposed between said plates such that a receiving space is defined between said plates, said plates having upper ends formed with a plurality of pairs of opposite indentations, said receiving space having a width identical with that of said partitioning blocks, said receiving space and said indentations being sized to allow insertion and reception of knives, said plates having a length greater than the knives such that the knives will not project from a lower end of a holder body after insertion thereinto, said partitioning blocks being arranged equi-distantly part from each other between said plates, i.e., between said indentations, so that the knives can be partitioned properly without overlapping, said partitioning blocks being provided with bolt portions at front and rear ends thereof, said bolt portions passing through and partly project from through holes in said plates for screwable engagement with central screw holes formed in inner sides of said securing blocks so as to assemble said plates with said partitioning blocks mounted between said plates, said plates each being further provided with two lower corner through holes for screwable engagement of said larger securing blocks such that said larger securing blocks project slightly from said lower ends of said plates to enable said holder body to stand on a planar surface, whereby said holder body provides a partitioning of the knives that can be seen through said plates, and prevents breeding of bacteria and mold.

* * * * *